United States Patent [19]

Franke

[11] Patent Number: 4,723,738

[45] Date of Patent: Feb. 9, 1988

[54] RAILWAY TRACK CIRCUIT FOR ELECTRIFIED TERRITORY INCLUDING IMPEDANCE BONDS AND INSULATED JOINTS

[75] Inventor: Raymond C. Franke, Glenshaw, Pa.

[73] Assignee: American Standard Inc., Pittsburgh, Pa.

[21] Appl. No.: 878,711

[22] Filed: Jun. 26, 1986

[51] Int. Cl.[4] ..... B61L 1/00

[52] U.S. Cl. ..... 246/34 C; 246/37

[58] Field of Search ..... 246/34 C, 35, 37, 38, 246/48, 42, 43, 72, 81, 120, 121

[56] References Cited

U.S. PATENT DOCUMENTS

| | | | |
|---|---|---|---|
| 1,770,705 | 7/1930 | Lucas | 246/37 |
| 2,854,567 | 9/1958 | Staples et al. | 246/34 C |
| 4,053,128 | 10/1977 | Frielinghaus et al. | 246/37 |

*Primary Examiner*—John W. Caldwell, Sr.
*Assistant Examiner*—Alvin Oberley
*Attorney, Agent, or Firm*—J. B. Sotak

[57] ABSTRACT

A center-fed track circuit arrangement for an electrified section of railroad track. A first and a second remotely located insulated joint defining the limits of the track circuit. A first impedance bond connected across the rails of the railroad track in the vicinity of the first remotely located insulated joint. A second impedance bond connected across the rails of the railroad track in the vicinity of the second remotely located insulated joint. A third impedance bond connected across the rails of the railroad tracks intermediate the first and second remotely located insulated joints. Each of the first and second impedance bonds includes a center tapped winding for accommodating propulsion current. A pair of tuned windings for accommodating at least two train detection signals having different frequencies. An untuned winding for exhibiting a low impedance at the frequency of a cab signal so as to mitigate leakage current across a broken-down insulated joint.

10 Claims, 2 Drawing Figures

RAILWAY TRACK CIRCUIT FOR ELECTRIFIED TERRITORY INCLUDING IMPEDANCE BONDS AND INSULATED JOINTS

FIELD OF THE INVENTION

This invention relates to a railway track circuit for electrified territory, and more particularly to a track circuit section for railroad interlockings in which the limits of the track circuit are confined by insulated joints and in which a plurality of impedance bonds are connected across the track rails and include a center tapped winding for allowing the passage of propulsion current between adjacent track circuits, a pair of tuned windings for accommodating at least two train detection signals and an untuned winding which presents a relatively low impedance at the frequency of a cab signal so that the cab signal current is confined within the limits of the track circuit even during breakdown of an insulated joint.

BACKGROUND OF THE INVENTION

In railway and rapid transit operations, it is a common practice to provide various train control signals at interlockings which employ insulated joints and impedance bonds to establish the length of track circuits and to precisely define the boundaries of the track circuit. Each of the impedance bonds must be capable of accommodating audio frequencies for both train detection and cab signals, as well as for handling propulsion current in electrified territory. Generally, insulated joints are unnecessary except in those areas around interlockings. The impedance bonds normally include a heavy wire multiple turn winding connected across the track rails and a center tap connector for permitting propulsion current to flow around the insulated joints. In addition, the impedance bonds include a plurality of other windings which are tuned to the frequencies of the train detection and cab signals. In the areas between interlockings, the track circuits are jointless and are commonly as long as 1200 feet. In this jointless territory, the track circuits are typically preshunted 40 or so feet in advance of the impedance bond. Therefore, the cab signal current flows past the bond and through the axles of the oncoming train to maintain a continuous cab signal indication. Because the bond is tuned, the impedance of the bond is relatively high in comparison to the impedance of the 40 feet preshunt of the track before the bond. However, in interlocking areas, the track circuits are relatively short, and it is common to have track circuits which are only 100 feet long. However, it is advantageous, from both an economic and operational standpoint, to attempt to utilize the same types of impedance bonds at interlockings as those used in jointless track areas. Previously, it was reported and verified that if an insulated joint failed there was sufficient leakage cab signal current to falsely signal an approaching train to proceed into the interlocking. For example, when two opposing trains approach an interlocking which is conditioned to make a turn-out move, it is necessary to ensure that a failed insulated joint will not permit the approaching train to enter the interlocking at the opposite end in order to prevent the possibility of a collision.

OBJECTS AND SUMMARY OF THE INVENTION

Therefore, it is an object of this invention to provide an improved track circuit for an interlocking in electrified territory in which a broken-down insulated joint will not falsely signal an approaching train to enter the interlocking.

Another object of this invention is to provide a unique broken-down insulated joint protection for track circuits having center tapped impedance bonds for conducting the flow of propulsion current.

A further object of this invention is to provide a novel railway track circuit for electrified territory having a plurality of insulated joints for defining the limits of the track circuit and having a plurality of impedance bonds for conveying train detection and cab signals to the track circuit and for conveying propulsion current between adjacent track circuits.

Still another object of this invention is to provide a new and improved railroad track circuit which includes insulated joints for confining the bounds of the track circuit and includes impedance bonds for conveying and/or receiving train detection signals and for conveying cab signals as well as for permitting the flow of propulsion current to the track circuit.

Still a further object of this invention is to provide a unique center-fed track circuit for electrified territory employing a plurality of center-tapped impedance bonds having a pair of windings which are tuned to the frequencies of a pair of train detection signals and a winding which is untuned at the frequency of a cab signal and a plurality of insulated joints for defining the limits of the track circuit.

Yet another object of this invention is to provide a railway track circuit which is efficient in operation, durable in service, versatile in application, and safe in usage.

Yet a further object of this invention is to provide a center-fed track circuit for a section of electrified railroad track comprising a first and a second spaced-apart insulated joint defining the limits of the track circuit, a first impedance bond connected across the rails of the railroad track adjacent said first spaced-apart insulated joint, a second impedance bond connected across the rails of the railroad track adjacent said second spaced-apart insulated joint, a third impedance bond connected across the rails of the railroad track at an intermediate location between said first and second spaced-apart insulated joints, each of said first and second spaced-apart impedance bonds includes a center tapped winding for accommodating propulsion current, a pair of tuned windings coinciding with the resonant frequencies of two train detection signals, and an untuned winding for lowering the impedance at the resonant frequency of a cab signal to confine the cab signal current within the limits of the track circuit in the event that an insulated joint becomes short-circuited to prevent an erroneous cab signal pick-up by an oncoming train in an adjacent track circuit.

An additional object of this invention is to provide an impedance bond for railway track circuits comprising a center tapped winding for conveying propulsion current between adjacent track circuit, a pair of tuned windings for accommodating at least two train detection frequency signals, and an untuned winding for exhibiting a low impedance at the frequency of the cab signal so that leakage current is confined within the limits of the track circuit in the event of a short-circuited insulated joint.

BRIEF DESCRIPTION OF THE DRAWINGS

The foregoing objects and other attendant features and advantages of this invention will become more readily understood from the following detailed description when considered in conjunction with the accompanying drawings, in which.

DETAILED DESCRIPTION OF THE INVENTION

Figure 1:
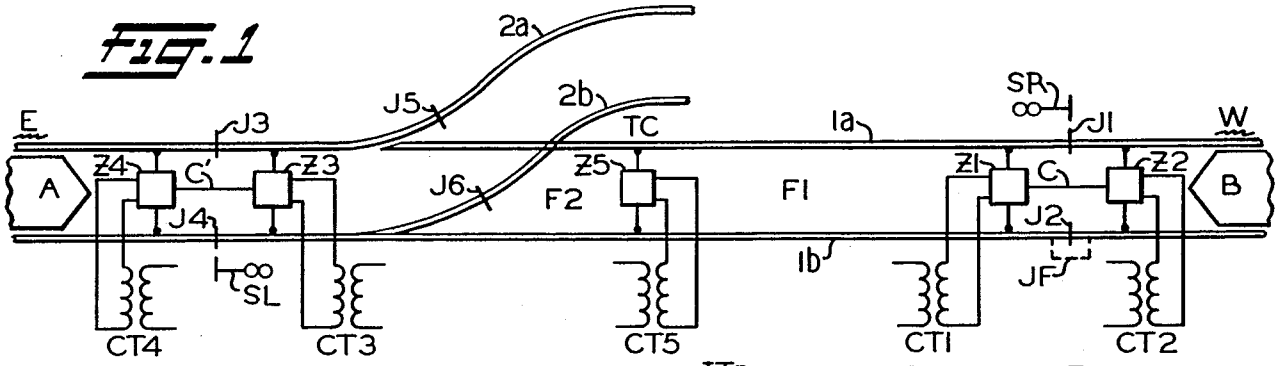
FIG. 1 is a schematic illustration of a railway track circuit located at a single turnout interlocking section embodying the subject invention.

Referring now to the drawings and in particular to FIG. 1, there is shown a pair of track rails 1*a* and 2*a* of a stretch of single mainline track having a turnout or siding which includes a pair of rails 1*b* and 2*b*. The limits of the track circuit TC are defined by a pair of insulated joints J1 and J2 located on the right, or west end, and by a pair of insulated joints J3 and J4 located on the left, or east end, as viewed in FIG. 1. Thus, the track circuit section TC is insulated from adjoining or adjacent right and left track sections by the pair of insulated joints J1, J2 and J3, J4, respectively, while the turnout tracks 1*b* and 2*b* are insulated by insulated joints J5 and J6. It will be noted that located at the right-hand end of the track circuit TC is a wayside signal SR which governs traffic from right to left, and located at the left-hand end is a wayside signal SL which governs traffic from left to right. It is assumed that the track section TC is part of a longer track stretch of an electrified railroad or light railway transit system in which the propulsion current passes through the track rails.

As shown in FIG. 1, the insulated joints J1 and J2 are straddled by a first pair of impedance bonds Z1 and Z2, while the insulated joints J3 and J4 are straddled by a second pair of impedance bonds Z3 and Z4. Another impedance bond Z5 is located intermediate the ends of the track circuit TC. It will be seen that the impedance bonds Z1, Z2, Z3, Z4, and Z5 are schematically represented as by blocks which are substantially identical, as will be described in greater detail hereinafter. Each of the impedance bonds are connected across the rails of the railroad track by suitable wires or conductors in a conventional manner. The impedance bonds Z1 and Z2 are interconnected by a center tapped conductor C to permit the flow of propulsion current between the right track section and the track circuit TC, while the impedance bonds Z3 and Z4 are interconnected by a center tapped conductor C′ to allow propulsion to flow between the left track section and the track circuit TC. It will be appreciated that control signals, such as train detection and cab signals, are inductive-coupled to the respective impedance bonds by isolation transformers CT1, CT2, CT3, CT4, and CT5 having suitable windings which function as secondary windings when the train detection and cab control signals are transmitted to the respective impedance bond and which functions as primary windings when the train detection control signals are received from the respective impedance bond. In analyzing the operation of the track circuit TC, it will be assumed that traffic moves in both directions so that it is necessary to protect train movement in both east-bound and west-bound directions. Under such an assumption, it will be appreciated that train detection signals are transmitted to the two end impedance bonds Z1 and Z3 via transformers CT1 and CT3, as well as to the intermediate impedance bond Z5 via transformer CT5. The impedance bonds Z1, Z3 and Z5 also include tuned windings for receiving at least two different train detection frequencies which are conveyed to appropriate receivers. The cab signals are center fed to the track circuit via the intermediate impedance bond Z5.

Figure 2:
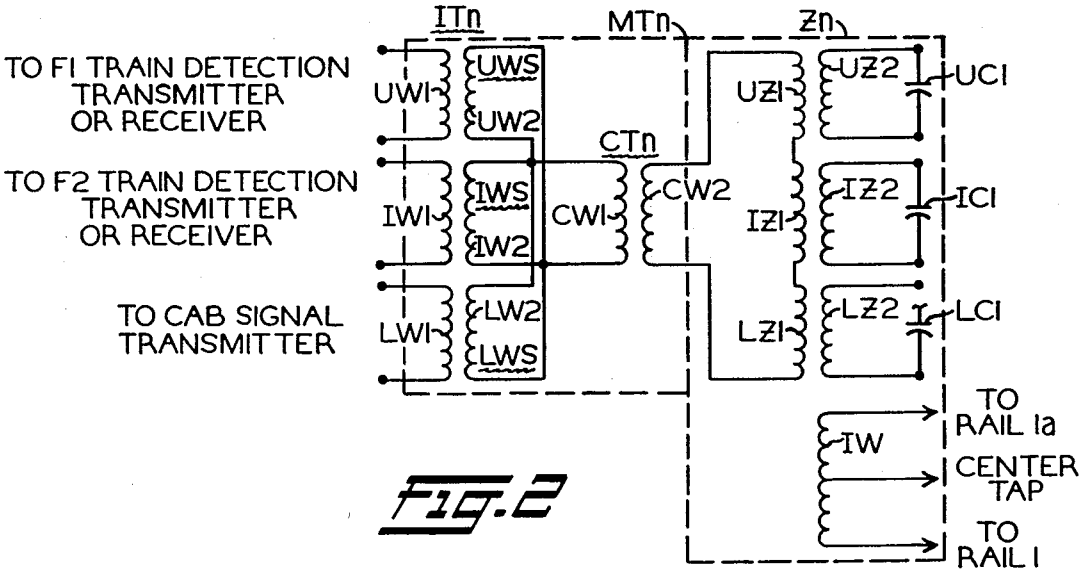
FIG. 2 is a circuit diagram of an impedance bond and a transformer coupling arrangement which may be utilized in the track circuit of FIG. 1.

Referring now to FIG. 2, there is shown a typical impedance bond Zn and matching transformer MTn configuration which may be employed for each of the impedance bonds Z1, Z3, and Z5 in the track circuit TC of FIG. 1. As shown, the matching transformer MTn includes an input transformer Itn and a coupling transformer CTn, which is representative of transformers CT1–CT5. The input transformer ITn includes a plurality of winding sections for accommodating the train detection and cab signals. As shown, the upper winding section includes a first and second winding UW1 and UW2. The first winding UW1 is selectively connected to either a first train detection transmitter or a first train detection receiver having a first signal frequency of F1. The intermediate winding section IWS includes a first and second winding IW1 and IW2. The first winding IW1 is selectively connected to either a second train detection transmitter or a second train detection receiver having a second signal frequency of F2. The lower winding section LWS includes a first and second winding LW1 and LW2. The first winding LW1 is suitably connected to a cab signal transmitter. In practice, the carrier frequencies of the train detection and cab signal are commonly in the range of 800 to 5,000 hertz which is coded by modulating signals having a frequency between 1 to 20 hertz. It will be seen that the second windings UW2, IW2 and LW2 are commonly connected in parallel with the first winding CW1 of the coupling transformer CTn. The second winding CW2 of the coupling transformer CTn is connected to a plurality of series connected windings UZ1, IZ1, and LZ1 of the impedance bond Zn. The upper impedance winding UZ1 is tuned to the resonant frequency of the train detection signal F1 by inductor capacitor circuit including a second winding UZ2 and a tuning capacitor UC1, while the intermediate impedance winding IZ1 is tuned to the resonant frequency of the train detection signal F2 by an inductor-capacitor circuit including a second winding IZ2 and a tuning capacitor IC1. The lower impedance winding LZ2 is detuned or untuned by disconnecting the tuning capacitor LC1 from at least one terminal of the second winding LZ2 of an inductor-capacitor circuit so that the impedance at the cab signal frequency can be decreased by a factor of nearly 10 to 1.

It will be noted that the impedance bond Zn includes a heavy wire center tapped inductive winding IW which is connected across rails 1*a* and 1*b* of the track circuit TC. At insulated joints, the center tap serves as the propulsion current return path from section to section.

Returning now to FIG. 1, it is assumed that train A, which is approaching from the east is about to make a turnout move on the siding track rails 2*a* and 2*b*, while at the same time a train B is approaching the track circuit TC from the west end. That is, with the two trains positioned as shown in FIG. 1, the interlocking can be conditioned for train A to make a turnout move. The wayside signal SR, at the west end, will display a stop command. The cab signals are transmitted from the center impedance bond Z5 for the train A to make the turnout move. If an insulated joint, such as joint J2, fails, as simulated by the dashed line JF, it is essential to ensure that sufficient cab signal current cannot reach the train B to activate a speed command. That is, it is necessary to make certain that the leakage current is not high enough for causing the possibility of a false call-on of the train B. It is recognized that train B may inadvertently go beyond the insulated joints J1 and J2, and thus receive the same cab signal as train A. The general term for such an event is overrun protection. If the train B moves into the overrun circuit, the circuit logic will ordinarily cut off or terminate the cab feed and will cause both trains to initiate a stop command. However, this is of little consequence since the distance between the trains is so short that a stop command will be too late to prevent a collision. That is, if the operator or automatic control system responds to the signal, it puts the two trains on a collision course because, even though the overrun protection apparatus would cut off the cab signal when train B passed the insulated joints, there would not be enough stopping distance to forestall a misshape. In the present instance, the untuned winding prevents the occurrence of a sufficient amount of current to leak by the failed insulated joint so as to preclude a cab signal response from the opposing train. It has been found through experimentation and calculation that detuning the impedance bond in this manner substantially reduces the amount of cab signal current which can flow past two short insulated joints so that the train carried cab signal equipment will not respond. Thus, this unique detuning technique is an appropriate means of confining the cab signal current so that positive protection is achieved against the failure of insulated joints. In practice, there is no reason for the impedance of the bond to be high at the cab signal frequency because there is no preshunting of the train circuit TC. It will be appreciated that by not tuning the bond, its impedance can be regulated or controlled to be equal to approximately seven (7) or eight (8) feet of rail impedance. Normally, the distance between rail connections at an insulated joint location is in the order of ten (10) feet. Therefore, the cab signal divides with the majority flowing through the bond winding rather than through the axle of the train B.

Thus, the present invention has been described in such full, clear, concise and exact terms as to enable any person skilled in the art to which it pertains to make and use the same, and in which the best mode contemplated of carrying out this invention has been set forth. I state that the subject matter, which I regard as being my invention, is particularly pointed out and distinctly claimed in what is claimed. It will be understood that variations, modifications, equivalents and substitutions for components of the above specifically-described embodiment of the invention may be made by those skilled in the art without departing from the spirit and scope of the invention as set forth in the appended claims.

What I claim is:

1. An impedance bond for railway track circuits comprising, a center tapped winding connected to a pair of track rails for conveying propulsion current between adjacent track circuits, spaced-apart insulated joints located in the track rails defining the limits of the track circuit, a pair of tuned windings inductively coupled to said center tapped winding for accommodating at least two train detection frequency signals, and an untuned winding inductively coupled to said center tapped winding for exhibiting a low impedance at a cab signal frequency so that leakage current of the cab signal frequency is confined within the limits of the track circuit in the event of a short-circuited insulated joint.

2. The impedance bond as defined in claim 1, wherein each of said pair of tuned windings is tuned to the resonant frequency of train detection signals by an inductor-capacitor circuit.

3. The impedance bond as defined in claim 1, wherein said untuned winding is detuned by disconnecting a lead of an inductor-capacitor circuit.

4. The impedance bond as defined in claim 1, wherein said center tapped winding is directly connected across the pair of track rails of the track circuit.

5. The impedance bond as defined in claim 1, said tuned and untuned windings are serially connected to a coupling transformer.

6. A center-fed track circuit for a section of electrified railroad track having track rails comprising, a first and a second spaced-apart insulated joint located in the track rails defining the limits of the track circuit, a first impedance bond connected across the track rails of the railroad track adjacent said first spaced-apart insulated joint, a second impedance bond connected across the track rails of the railroad track adjacent said second spaced-apart insulated joint, a third impedance bond connected across the track rails of the railroad track at an intermediate location between said first and second spaced-apart insulated joints, each of said first and second spaced-apart impedance bonds includes a center tapped winding connected across the track rails for accommodating propulsion current, a pair of tuned windings inductively coupled to said center tapped winding coinciding with a pair of resonant frequencies of two train detection signals, and an untuned winding inductively coupled to said center tapped winding for lowering the impedance at the resonant frequency of a cab signal to confine the cab signal within the limits of the track circuit in the event that an insulated joint becomes short-circuited to prevent an erroneous cab signal pick-up by an oncoming train in an adjacent track circuit.

7. The center-fed track circuit as defined in claim 6, wherein said pair of tuned windings and said untuned winding are serially connected to a coupling transformer.

8. The center-fed track circuit as defined in claim 6, wherein each said pair of tuned windings are tuned to the resonant frequencies of the two train detection signals by a pair of inductor-capacitor circuits.

9. The center-fed track circuit as defined in claim 6, wherein said untuned winding is detuned by opening an inductor-capacitor circuit.

10. The center-fed track circuit as defined in claim 7, wherein a multiple winding input transformer is connected to said coupling transformer.

* * * * *